United States Patent [19]

Gage

[11] Patent Number: 4,874,178

[45] Date of Patent: Oct. 17, 1989

[54] PARLOR LOTTERY GAME

[76] Inventor: George J. Gage, 2201 N. Beverly Glen Blvd., Los Angeles, Calif. 90077

[21] Appl. No.: 296,605

[22] Filed: Jan. 13, 1989

[51] Int. Cl.[4] ..... A63F 3/06

[52] U.S. Cl. ..... 273/274; 273/144 B

[58] Field of Search ..... 273/144 R, 144 A, 144 B, 273/274; 211/14

[56] References Cited

U.S. PATENT DOCUMENTS 2,582,245 1/1952 Folli ..... 211/14
2,665,915 1/1954 Steig ..... 273/144 B
3,589,728 6/1971 McFarland ..... 273/144 BX

FOREIGN PATENT DOCUMENTS 1151691 8/1983 Canada ..... 273/144 B
2456777 8/1976 Fed. Rep. of Germany ..... 273/274

*Primary Examiner*—Anton O. Oechsle

[57] ABSTRACT

A parlor board game is disclosed herein comprised of an indicia board, a transparent shaker device containing forty-nine spherical balls imprinted with identical indicia as imprinted on the playing board and color-coded players' chips or coins used for betting on preselected indicia on the board. The shaker device determines the winning indicia symbols for each round of play.

1 Claim, 1 Drawing Sheet

PARLOR LOTTERY GAME

FIELD OF THE INVENTION

The present invention relates to a parlor game of chance in which the participants include a banker and one or more players. Further, the game is of the type played with a numbered playing board, banker chips, player chips and a shaker device for selecting game winning numbers.

BACKGROUND OF THE INVENTION

In recent years, there has been a tremendous interest and participation in state lottery games. In a number of such games players pick six numbers on a game ticket. The winning numbers are randomly selected by a st- operated device containing numbered ping pong ball and including means for ejecting six of the balls into a retaining chute which determine the winning numbers. The player that has selected three to six of the numbers on his lottery ticket wins a prize.

Roulette is another game of chance whereby players are required to select numbers on a gaming board or table marked off with numbers from 1 to 36, one or two zeros, and several other sections affording the players a variety of betting opportunities. A numbered roulette wheel or bowl into which a small ball is spun and upon its capture in one of 37 or 38 compartments indicates the winning number and its characteristics, as odd or even, red or black, and between 1 and 18 or 19 and 36.

Thus in the field of games of chance heretofore known, only a few have been adapted for use in the home and more specifically as a parlor game of chance to be played on the kitchen or dining table by all members of the family and/or their friends.

Accordingly, it is an object of the present invention to provide a game of chance whereby two or more players can participate and experience the anticipatory feeling of hitting the jackpot by placing their bets on the playing board.

Another object of the invention is to provide a game of chance to be played in the home environment which is both entertaining and recreational.

A further object is to provide a game of chance whereby one of the components of the game, the winning number selection device, can also be utilized for selecting numbers on an actual state lottery ticket.

Briefly, these and other objects are achieved by providing a game of chance for two or more players where each player has the equal opportunity of winning or losing without any basic skill requirements or knowledge, thereby precluding an age limit for the participants.

Other objects and advantages of the invention will become apparent from the following summary and detailed descriptions of preferred embodiments of the invention taken in conjunction with the accompanying drawing figures.

SUMMARY OF THE INVENTION

This invention relates to a parlor board game which permits two or more players to participate in a novel game of chance wherein bets are placed on the numerical indicia of a playing board and the winning bets are determined by the game banker via a shaker device wherein numbered balls are randomly captured in a transparent read-out handle thereby indicating the winning numbers for that round of play. The players are required to place a specific number of bets on the playing board for each round of play. Bets placed on winning numbers receive a banker's chip. The banker's chip is redeemable for six player's chips. A player selecting all winning numbers during one round of play breaks the bank by winning all of the banker's chips and thus wins the game. Player's chips placed on non-winning numbers are retrieved by the banker. Players who lose all of their chips are eliminated from the game and the game is over when all players lose their chips.

BRIEF DESCRIPTION OF THE DRAWING FIGURES

In order to facilitate understanding of the present invention and the basic rules of the game, reference will now be made to the appended drawing figures of preferred specific embodiments of the present invention. Such drawing figures should not be construed as limiting the invention which is properly set forth in the appended claims.

DETAILED DESCRIPTION OF THE PREFERRED EMBODIMENTS

Figure 1:
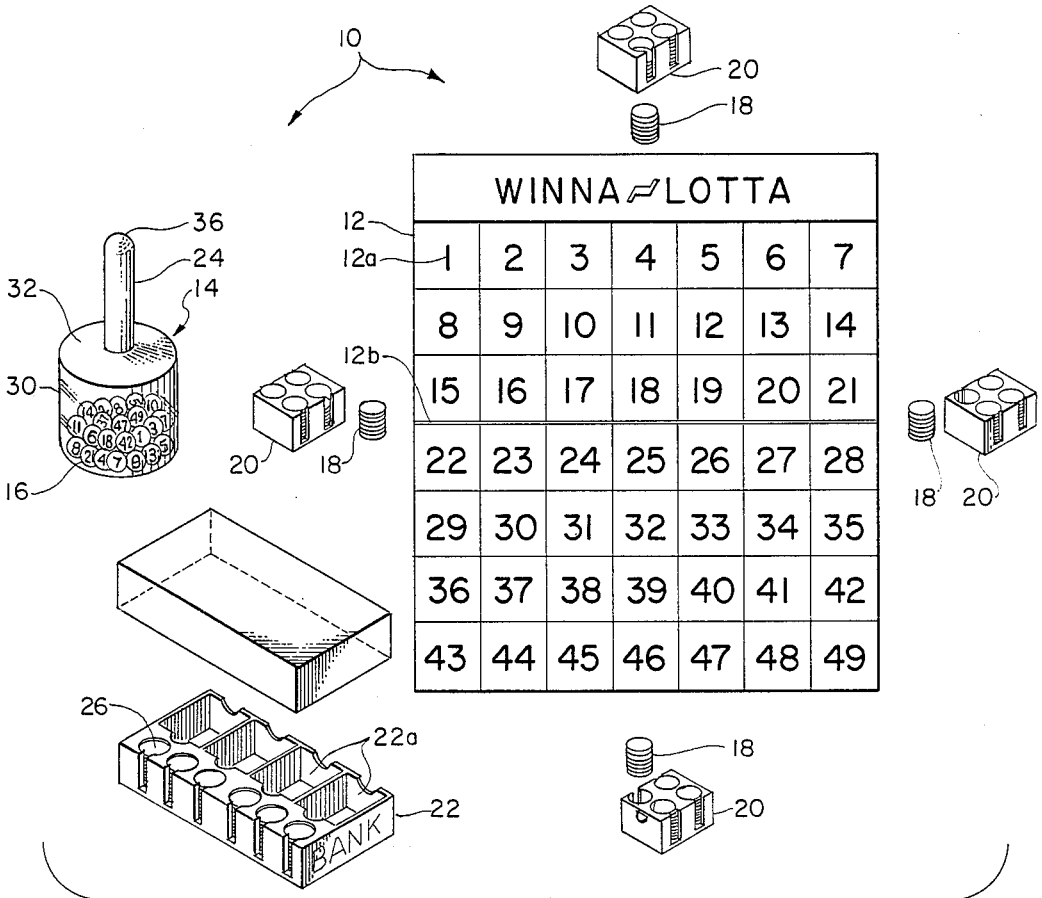
FIG. 1 is a perspective view of all of the components and the playing board of the game comprising the present invention.

Referring initially to FIG. 1, there is illustrated all of the component parts of the parlor lottery game identified as 10. The playing board 12 as shown is imprinted with large numerical indicia 12*a* on a square grid pattern. The board 12 folds at 12*b* for storage or packaging purposes. The numbers 12*a* are in consecutive order, for example, from one to forty-nine. Said imprinted indicia 12*a* duplicate the number selection provided on the state lottery tickets of California. It should be noted here that the progressive number system can be expanded as desired to correspond with numerical systems having more or less than forty-nine numbers.

A transparent shaker device 14 containing numbered balls 16 is provided to an assigned "banker" at the beginning of the game. Colored players' chips 18 in containers 20 are distributed to all of the players including the banker. The players' chips 18 may be colored red, blue, black, and white enabling each player to distinguish his bet from other players' bets when placed on the playing board 12.

For every round of play, each player must place a selected number of his colored chips 18 on six numbers 12*a* on the board 12. Six chips must be played by each player every round where the game corresponds to the California lottery. The banker shakes the shaker 14 and inverts it so that numbered balls 16 enter the hollow handle 24. The numbered balls represent the winning numbers for that round of play.

For each player's chip 18 placed on a winning number, the player receives a banker's chip 26 which is equal in value to six player's chips 18. The banker's chip may be cashed-in for six player's chips 18 at the time the player has depleted his supply of chips. The player's chips that were placed on non-winning numbers on the board 12 are racked-in by the banker and deposited in the appropriate color-coded compartment 22a in the banker's container 22. The duties of the banker may be rotated after five or more rounds of play.

The game is officially ended under the following conditions: the players lose all of their chips 18, the banker loses all of the banker's chips 26; or if a player hits all six winning numbers at which time he "breaks-the-bank" and receives all of the banker's chips in the bank.

Figure 2:
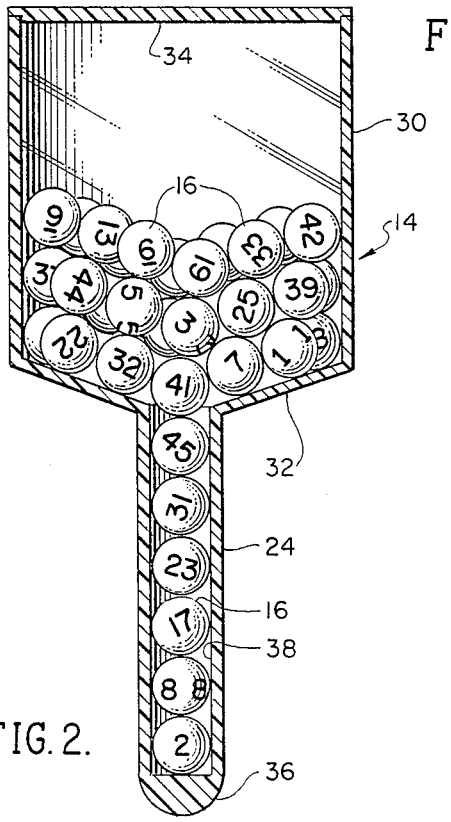
FIG. 2 is a cross-sectional view of a first form of indicia shaker device which determines the random selection of indicia for one round of play of the game of the invention.

Referring now to FIG. 2, the shaker 14 has a cylindrical wall 30, a funnel-shaped bottom 32 and a sealed top 34. The top 34 is cemented in place after the proper quantity of numbered balls 16 are inserted, i.e., in the exemplary case, forty-nine balls numbered one through forty-nine. The balls 16 may be made of white plastic having black numerals imprinted on the surface. Three or four identical numbers may be imprinted on the spherical surface of each ball. The funnel-shaped bottom 32 with the extending hollow handle 24 is formed integral with the upper cylindrical body 30. The end of the handle 24 is sealed at 36, providing an interior cavity 38 the length of which is equal to the sum of the diameters of six number balls 16. To increase the number of balls funneled into the handle 24, the length of the handle can be increased, thus increasing the number of winning numbers.

Figure 3:
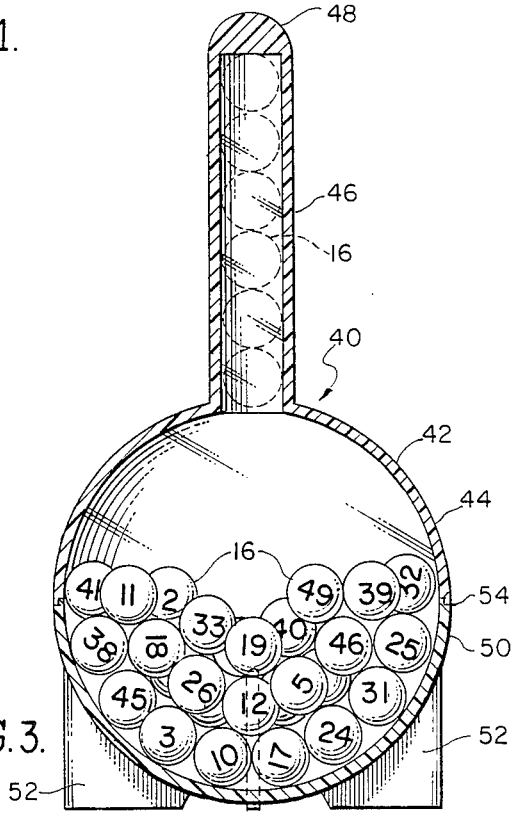
FIG. 3 is a cross-sectional view of an alternate configuration of the indicia shaker device of the invention.

Referring now to FIG. 3, an alternate configuration of the shaker device is shown. This shaker 40 has a globe-type chamber 42 which contains the forty-nine numbered balls 16. The upper half 44 of the globe chamber 42 has an integral hollow handle 46 similar to handle 24 of the aforementioned shaker 14. The end of the handle 46 is sealed at 48. The lower half 50 of the shaker 40 has four extending fins 52 which enable the shaker to stand upright when not in use. The upper and lower halves, 44 and 50, of the shaker 40 are cemented together at the seam 54 after the proper amount of numbered balls 16 are enclosed. In playing the game, the shaker 40 is rattled to mix the numbered balls 16 and then inverted to funnel six balls 16 (shown in phantom) into the hollow handle 46, thus randomly selecting the six winning numbers.

METHOD FOR PLAYING

A banker is assigned at the beginning of the game who distributes an equal number of colored players' chips to each of the players including himself. Where ninety-six chips are given to each player, each player will be able to play a minimum of sixteen rounds. The colored chips enable each player to distinguish his bet from the other players' bets.

At the beginning of each round of play, each player must place six of his colored chips on six different numbers on the playing board paralleling the number of number selections made for each play of the California lottery.

When all bets are placed, the banker shakes the shaker containing the numbered balls and inverts it to funnel six balls into the hollow handle thus selecting the winning numbers for that round of play.

The banker pays off each player having his colored chip on a winning number with one banker's chip. One banker's chip can be redeemed for six player's chips when needed.

The players' chips that are placed on non-winning numbers are racked in by the banker and deposited in the appropriate color-coded compartment in his bank.

If a player loses all of his chips, he is eliminated from play.

If a player has selected all six winning numbers during one round, he "breaks-the-bank" and wins all of the chips in the bank.

The game is officially ended under the following conditions:

(1) All of the players lose all of their chips and can no longer play.

(2) The banker loses all of the chips in the bank.

The duties of the banker may be rotated to the other players after five or more rounds of play.

It is to be noted that the present inventive concept includes the shaker for use with any game and as such includes a hollow container integrally joined with an elongated hollow protrusion or handle. A selection means joins the hollow interiors of the container and the protrusion so that a one-at-a-time selection of game pieces or balls are transferred via gravity from the container to the handle or protrusion. The length of the protrusion determines how many game pieces occupy the interior hollow thereof. Therefore, the entrance to the hollow interior of the protrusion serves as a gate for conducting passage of only as many game pieces are are necessary to fully occupy the protrusion hollow interior or handle 46. The size of the hollow interior is slightly larger than the size of the game pieces so that entrance will permit only one game piece at a time to transfer from the container to the protrusion.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A parlor board game for two or more participating players comprising:

a foldable playing board having a square grid pattern whereon numerical indicia are imprinted;

said numerical indicia are imprinted on the surface of the board in a consecutive order;

said imprinted numerical indicia duplicating the numerical sequence imprinted on the tickets of a state lottery;

a hollow transparent shaker device;

said transparent shaker having enclosed therein a plurality of spherical balls imprinted with numerical indicia conformal to the indicia imprinted on said playing board;

said transparent shaker having a transparent hollow handle wherein a restricted quantity of said balls can be funneled from an enlarged chamber of said shaker into said handle to provide a random selection of numbers or indicia to facilitate the playing of the game;

a plurality of colored players' chips, distributed equally to each of the participating players in accordance to their color distinction at the commencement of the game;

a player's chip deposit box wherein said player's chips can be deposited during the progression of the game, said container color-coded to match said colored player's chips to be contained therein;

a banker's container wherein a plurality of separate color-coded compartments permits the storage of players' pay-off chips as well as the players' chip deposit boxes; and an enclosing cover for said banker's container.

* * * * *